US008726975B2

(12) United States Patent
Schmidt

(10) Patent No.: US 8,726,975 B2
(45) Date of Patent: May 20, 2014

(54) AIR-SUPPLIED DRY COOLER

(75) Inventor: Markus Schmidt, Herten (DE)

(73) Assignee: GEA Energietechnik GmbH, Bochum (DE)

( * ) Notice: Subject to any disclaimer, the term of this patent is extended or adjusted under 35 U.S.C. 154(b) by 1078 days.

(21) Appl. No.: 12/678,588

(22) PCT Filed: Aug. 12, 2008

(86) PCT No.: PCT/DE2008/001325

§ 371 (c)(1), (2), (4) Date: Mar. 17, 2010

(87) PCT Pub. No.: WO2009/036719

PCT Pub. Date: Mar. 26, 2009

(65) Prior Publication Data

US 2010/0206530 A1 Aug. 19, 2010

(30) Foreign Application Priority Data

Sep. 18, 2007 (DE) ..... 10 2007 044 658

(51) Int. Cl.
*F28B 3/00* (2006.01)

(52) U.S. Cl.
USPC ..... 165/114; 165/111

(58) Field of Classification Search
USPC ..... 165/114, 113, 111; 210/109, 151, 187, 210/175
See application file for complete search history.

(56) References Cited

U.S. PATENT DOCUMENTS 1,662,186 A * 3/1928 Grace ..... 165/114
RE17,433 E * 9/1929 Ehrhart ..... 165/114
1,772,807 A * 8/1930 Grace ..... 165/114
1,855,231 A * 4/1932 Grace ..... 165/114
1,855,390 A * 4/1932 Ehrhart ..... 165/113
2,181,704 A * 11/1939 McNeal ..... 165/114
3,073,575 A * 1/1963 Schulenberg ..... 165/146
3,262,489 A * 7/1966 Fritzberg ..... 165/175
3,612,172 A * 10/1971 Dohnt ..... 165/111
3,710,854 A * 1/1973 Staub ..... 165/111
3,938,588 A * 2/1976 Coit et al. ..... 165/113
4,129,180 A * 12/1978 Larinoff ..... 165/113
4,168,742 A * 9/1979 Kluppel et al. ..... 165/114
4,220,194 A * 9/1980 Shade et al. ..... 165/113
4,254,825 A * 3/1981 Imazu ..... 165/114
4,295,341 A * 10/1981 Gale ..... 62/100
4,330,034 A * 5/1982 Lang et al. ..... 165/113
4,815,296 A * 3/1989 Amir ..... 60/651

(Continued)

FOREIGN PATENT DOCUMENTS

CH 361 018 A 3/1962
DE 18 73 644 U 6/1963
DE 44 39 801 A1 5/1996
TW 097135625 5/1999

*Primary Examiner* — Marc Norman
*Assistant Examiner* — Devon Russell
(74) *Attorney, Agent, or Firm* — Henry M Feiereisen LLC

(57) ABSTRACT

An air-supplied dry cooler for the condensation of water vapor includes at least one direct-flow condenser and at least one counter-flow condenser (dephlegmator), wherein heat exchanger pipes of the counter-flow condenser are connected to an upper suction chamber, and wherein a cover reducing the discharge cross-section of at least one heat exchanger pipe is provided with cover orifices. The sum of the cross-sectional surfaces of the cover orifices corresponds to no more than the cross-sectional surface of a suction pipe connection to the suction chamber.

13 Claims, 2 Drawing Sheets

(56) References Cited

U.S. PATENT DOCUMENTS

| | | | | | |
|---|---|---|---|---|---|
| 4,878,535 | A | * | 11/1989 | Rosenblad | 165/114 |
| 4,903,491 | A | * | 2/1990 | Larinoff | 60/692 |
| 5,139,083 | A | * | 8/1992 | Larinoff | 165/113 |
| 5,448,830 | A | * | 9/1995 | Borchert et al. | 29/890.046 |
| 5,632,329 | A | * | 5/1997 | Fay | 165/113 |
| 5,653,281 | A | * | 8/1997 | Berg et al. | 165/113 |
| 5,787,970 | A | * | 8/1998 | Larinoff | 165/111 |
| 5,950,717 | A | * | 9/1999 | Fay | 165/113 |
| 6,142,223 | A | * | 11/2000 | Bodas et al. | 165/183 |
| 6,332,494 | B1 | * | 12/2001 | Bodas et al. | 165/112 |
| 6,474,272 | B2 | * | 11/2002 | Bensing et al. | 122/459 |
| 6,588,499 | B1 | * | 7/2003 | Fahlsing | 165/231 |
| 7,096,666 | B2 | * | 8/2006 | Fay | 60/685 |
| 7,237,600 | B2 | * | 7/2007 | Tippmann | 165/119 |
| 8,191,259 | B2 | * | 6/2012 | Schabosky et al. | 29/890.07 |
| 2002/0005176 | A1 | * | 1/2002 | Bensing et al. | 122/459 |
| 2006/0086092 | A1 | * | 4/2006 | Fay | 60/685 |
| 2008/0006395 | A1 | * | 1/2008 | Sanderlin et al. | 165/110 |
| 2009/0178279 | A1 | * | 7/2009 | Schabosky et al. | 29/890.07 |
| 2010/0175865 | A1 | * | 7/2010 | Murphy | 165/200 |
| 2011/0017432 | A1 | * | 1/2011 | Kulankara et al. | 165/115 |

* cited by examiner

AIR-SUPPLIED DRY COOLER

CROSS-REFERENCES TO RELATED APPLICATIONS

This application is the U.S. National Stage of International Application No. PCT/DE2008/001325, filed Aug. 12, 2008, which designates the United States and has been published as International Publication No. WO 2009/036719 and which claims the priority of German Patent Application, Serial No. 10 2007 044 658.8, filed Sep. 18, 2007, pursuant to 35 U.S.C. 119(a)-(d).

BACKGROUND OF THE INVENTION

The invention relates to an air-supplied dry cooler for condensing steam.

It is known to use air for condensing turbine steam. With direct air-cooled condensation, the turbine steam is condensed in ribbed pipe elements (surface condensers) connected in parallel, and the condensate is returned to the feed water loop. The interior of the ribbed pipe elements is under vacuum, with the non-condensable gases being suctioned off. The cooling air flow is generally produced with fans, rarely by natural airflow. Dry coolers with a roof structure (A-arrangement) are widely used. The ribbed pipe elements form hereby the legs of a triangle, with the fans arranged at the base.

The surface condensers can be connected in two ways: on one hand, in a direct-flow condenser arrangement and, on the other hand, in a counter-flow arrangement (dephlegmator arrangement). In the direct-flow condenser, the steam flows from a distribution line located at the top downwards into the direct-flow condenser. The condensate which also flows downwards is collected in a condensate collection line. In the counter-flow condenser arrangement, the exhaust steam is introduced into the cooling pipes from below and flows therefore against the discharged condensate. In practical applications, direct-flow condensers and the counter-flow condensers are combined with one another. The so-called "condensation end" of the steam is then located in the counter-flow condenser.

It is known to provide an intermediate bottom with recesses (DE-GM 18 73 644) in the steam distribution chamber in order to uniformly distribute the steam flow introduced into the steam distribution chamber of a counter-flow condenser. The total flow cross-section of the recesses is sized smaller than the total cross-section of the condenser pipes.

Conversely, it is known from DE 44 39 801 C2 that most of the dephlegmators have resistance elements in the region of their ends facing the gas collector. The exhaust steam then experiences a resistance caused by the introduced uniform distribution of the steam entering the individual dephlegmator pipes from below. With this introduced uniformity, the entire condenser surface is predominantly utilized for the condensation, preventing the formation of "cold nests" or "dead zones", where neither exhaust steam nor condensate is present. However, problems may arise in certain situations when larger quantities of the condensate accumulate in the suction chamber at low temperatures. The large quantities of condensate can cause supercooling and in extreme situations even freezing of the condensate. This danger exists at outside temperatures below freezing, both during operation and during startup, because the large quantity of frozen condensate located just below the baffle opening may not be thawed quickly enough by the gas-steam mixture, so that the newly generated condensate quickly freezes and may in extreme situations block the baffle openings.

Another problem can arise when large quantities of condensate accumulate in the suction chamber, which must be returned to the dephlegmator pipes through the same opening through which the gas-steam mixture enters the suction chamber. The counter-flow through the gas-steam mixture can produce "swallowing" in the region of the individual openings, temporality separating the gas-steam flow. This may cause undesirable pressure variations inside the individual dephlegmator pipes.

It is an object of the invention to improve an air-supplied dry cooler for condensing steam so as to attain a high overall efficiency, and to reliably prevent freezing of the dephlegmator, and separation of the gas-steam flow entering the suction chamber.

SUMMARY OF THE INVENTION

This object is attained with a dry cooler which includes at least one direct-flow condenser, at least one counter-flow condenser (dephlegmator) having heat exchanger pipes, a plurality of heat exchanger pipes having outlet openings, a suction chamber having a bottom and being connected to the heat exchanger pipes, a baffle with baffle openings for reducing an outlet cross-section of at least one of the heat exchanger pipes; and a gas barrier in form of a siphon. Condensate enters the suction chamber through a baffle opening, accumulates in the bottom of the suction chamber and is returned to a heat exchanger pipe via the gas barrier.

The condensate entering through the baffle openings into the suction region accumulates in the bottom of the suction chamber and can be returned to a heat exchanger pipe via a gas barrier in form of a siphon. The gas barrier is provided to ensure that suction in the suction chamber does not cause the gas or steam to flow past the baffle opening into the suction chamber. This can be prevented by a gas barrier in form of a siphon.

It is important with the invention that the siphon outlet separates the gas-steam flow from the counter-flow of the condensate. This prevents swallowing in the region of the individual baffle openings, because the condensate flows out via a separate path and introduced again directly into the heat exchanger pipes. Advantageously, only small quantities of condensate accumulate in the bottom of the suction chamber. Small quantities of condensate can be heated faster by the suctioned-off gas-steam mixture, thereby preventing freezing during continuous operation. This increases the operational safety. Moreover, pressure fluctuations inside the dephlegmator pipes are prevented, because the condensate does no longer impede the gas-steam flow.

In an advantageous embodiment, the gas barrier is formed by the baffle, a pipe bottom arranged underneath the baffle, with the heat exchanger pipes welded to the pipe bottom, and the accumulating condensate itself. The condensate can hereby flow back directly into the heat exchanger pipes through the outlet openings of the heat exchanger pipes affixed on the pipe bottom and intermix with the precipitating condensate. The baffle can here form a part of a bottom plate of the suction chamber. Condensate outlet openings are arranged within the gas barrier in the bottom plate and/or the baffle to allow the condensate to drain. The condensate outlet openings are preferably disposed in the bottom of the baffle and/or the bottom plate.

When the heat exchanger elements are arranged in the shape of a roof, the pipe bottom holding the heat exchanger pipes is sloped with respect to a horizontal. Because the baffle opening associated with an outlet opening of a heat exchanger pipe has a significantly smaller cross-section than the heat exchanger pipe, the lowest point of the outlet opening is located below the lowest point of the baffle opening due to the scope of the pipe bottom. In other words, condensate accumulating in the suction chamber cannot back up to the height of the baffle opening, because it will drain before over the lower edge of the outlet opening of the heat exchanger pipe and flow out of the suction chamber in this way. Accordingly, the suction chamber is prevented from being flooded. The operation of the suction chamber would not be adversely affected even if the condensate backed up in the gas barrier would freeze, because the baffle openings are located above the outlet openings of the heat exchanger pipes. During ongoing operation, i.e., when the condensate flows again through the baffle openings into the suction chamber, any frozen condensate would quickly melt and immediately flow out through the heat exchanger pipes.

Advantageously, the invention utilizes the weld seam bump, which connects the heat exchanger pipes with the pipe bottom, as a seal in the region of the connection between the pipe bottom and heat exchanger pipe. The weld seam bump is not at risk of gap corrosion because a residual gap of about 1-2 mm remains. Due to a maximum spacing of 2 mm, preferably of not more than 1 mm, the seal is sufficiently tight to prevent steam or gas from being sucked in from neighboring heat exchanger pipes that are not located directly below the baffle opening. In addition, accumulated condensate in the region of the weld seam bumps can flow in and out of the heat exchanger pipes. Gap corrosion is prevented by adequate spacing between the outlet opening and the bottom plate.

Manufacture is particularly advantageous when a pair of dephlegmators which are arranged opposite one another in the shape of a roof are connected to a common suction chamber. This does not mean that the suction chamber of two dephlegmators is provided with only a single suction pipe, but that a single suction chamber is installed on the dephlegmators instead of two separately manufactured suction chambers. With roof-shaped dephlegmators, the lowest point of the ridge region is located between the pipe bottom of the dephlegmators. This is the region where the condensate accumulates. In an advantageous embodiment, the condensate accumulates up to a blocking height, with a separation wall immersed in the condensate and separating the suction chamber, by forming a gas barrier, into a first sub-chamber associated with the first dephlegmator and a second sub-chamber associated with the second dephlegmator. Each sub-chamber is provided with dedicated suction. The condensate is drained from the lowest region through the condensate outlet openings located in the bottom plate of the suction chamber.

In a structurally particularly advantageous embodiment, the separation wall may be formed by a cover plate which closes the suction chamber off. The cover plate as well as the bottom plate may be formed from a folded sheet bar. The sheet bar is provided with perforations in the region of the baffle openings and the suction pipe. In addition, the condensate outlet openings are manufactured. The perforated sheet bar is folded commensurate with the slope of the pipe bottoms. In addition, the sidewalls, on which the suction pipes are mounted, together with the bottom plate may be produced from the sheet bar as a single piece. The sidewalls and the bottom plates form a kind of trough, on which the cover plate is placed. The cover plate needs only to be folded only once, namely so that its fold is located in the final installation position below the lowest regions of the outlet openings of the heat exchanger pipes, in order to form a gas barrier. The cover plate is hence bent more strongly than the sheet bar between the two bottom plates.

A suction chamber prefabricated in this manner can have spacers positioned in the region of its sidewalls and supported on the pipe bottom of the heat exchanger. The spacers also operate as vacuum support and to define a fixed spacing between the pipe bottom and the bottom plate. The suction chamber can be welded to the pipe bottom with a fillet weld formed in the transition region between the side wall and bottom plate.

The cross-sectional wedge-shaped design of the suction chamber enables a simple design of the shape of the cover plate and the bottom plate and also an advantageous flow characteristic. The cover plate can be reinforced by vacuum supports arranged in triangular form and located above the cover plate.

The dry cooler according to the invention optimizes the construction of the suction chamber, because the bottom plate with the baffle openings is simply a component of a prefabricated finished chamber. The bending radii generated when the chamber is produced automatically create weld contours for subsequent welding to the pipe bottoms, reducing the overall costs.

With the suction chamber constructed according to the invention, there is advantageously no longer a difference in the configuration of the individual pipe bundles between counter-flow and direct-flow condensers. This is foremost a logistic advantage, because it now becomes unimportant in which order the condensers are installed at the construction site. The condensers can then be installed regardless of their connection, and the connection as counter-flow condenser or direct-flow condenser can be determined at a later time. The completely prefabricated suction chambers are placed on the individual heat exchanger elements operated in a counter-flow configuration and connected with the pipe bottoms only after the pipe bottoms have been welded gas-tight.

Preferably, the sum of the cross-sectional areas of the baffle openings associated with the individual heat exchanger pipes is at most equal to the cross-sectional area of a suction pipe connected to the suction chamber.

Unexpectedly, the cross-sectional area of the baffle opening was found to be directly related to the cross-sectional area of the suction pipe. Such relationship has not previously been identified. A match of the cross-sectional areas makes it possible to use, due to the relative small baffle openings, suction pipes having also relatively small cross sections, wherein advantageously only a single suction pipe needs to be connected to the suction chamber for each dephlegmator, which significantly reduces the previously required welding tasks. It should be noted that counter-flow condensers used for condensing steam of a power plant have typically a width in excess of 2 m for each pipe bundle, so that hitherto three suction pipes distributed across the width of the pipe bundles were connected to respective suction chambers, and the suction chambers were not separated from one another in a gas-tight fashion. Until now, connecting the individual suction chambers with a collecting line during installation by way of a large number of individual suction fittings was quite complicated, because a large number of weld seams were required. The risk of leakage increases with the number of weld seams. Disadvantageously, the weld seams must frequently be welded at the installation site in an overhead position, so that the welding operation is complicated and time-consuming.

By matching the cross-sectional areas according to the invention, the three individual, separate suction chambers for each dephlegmator can be eliminated and only a single suction chamber with only a single central suction needs to be provided. This significantly reduces the number of weld seams and the risk of leakage. Uniform suction of gas and/or steam from the individual heat exchanger pipe is important in sizing the individual cross sections. To this end, the cross-section of the individual baffle openings can vary, for example increase towards the marginal region, i.e., in the regions further removed from the suction pipe, and may be smaller towards the center region immediately adjacent to the suction. The diameters can change continuously or in steps. For example, the graduation can have three parts, i.e., the baffle openings with the smallest cross-sectional areas may be located in the center region adjacent to the suction pipe. The baffle openings with the largest cross-sectional areas may be located in a region near the edge, and baffle openings with intermediate cross-sectional areas may be located therebetween.

BRIEF DESCRIPTION OF THE DRAWING

The invention will now be described in more detail with reference to an exemplary embodiment depicted in the drawings. It is shown in.

DETAILED DESCRIPTION OFPREFERRED EMBODIMENTS

Figure 1:
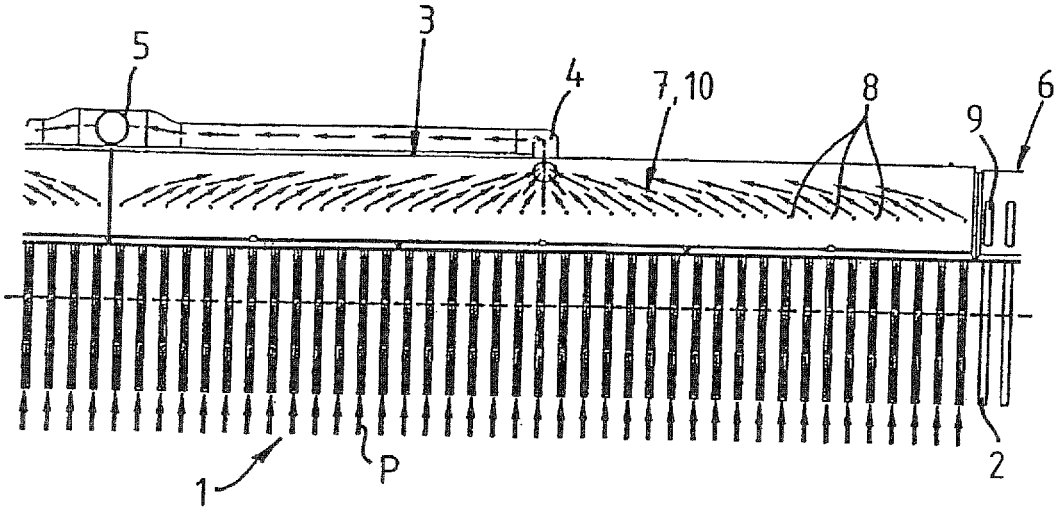
FIG. 1 a longitudinal section through a suction chamber in the upper region of a counter-flow condenser.

FIG. 1 shows the upper region of the direct-flow condenser (dephlegmator) 1 of an air-supplied dry cooler, which is not illustrated in its entirety, for condensing steam. The flow direction of the vapor is indicated by the arrows P. The steam rises inside heat exchanger pipes 2 arranged in parallel and enters a suction chamber 3. A suction pipe 4, through which the steam-gas mixture is suctioned off the dephlegmator 1, is connected at the center of the suction chamber 3. As depicted in the perspective diagram of FIG. 2, two respective suction chambers 3 are each connected to a central suction 5.

FIG. 1 further shows on the rightmost side of the Figure a portion of a direct-flow condenser 6. The direct-flow condenser 6 is not provided with a suction chamber 4, because the steam flows downward from the top. However, the heat exchanger pipes 2 have the same cross-section as the heat exchanger pipes of the dephlegmator 1. As clearly indicated, the suction chamber 3 has significantly smaller openings for passage of the steam-gas mixture, because a baffle 7 with baffle openings 8, which reduces the outlet cross-section of the heat exchanger pipes 2, is arranged above the outlet openings 9 of the individual heat exchanger pipes 2. The baffle 7 is part of a bottom plate 10 of the suction chamber 3. The sum of the cross-sectional areas of the individual baffle openings 8 does not exceed the cross-sectional area of the suction pipe 4 connected to the suction chamber 3. This provides a particularly uniform suction of the steam-gas mixture and generally prevents cold zones in the heat exchanger pipes 2 of the dephlegmator 1. More particularly, with this particular match of the cross sections, only one suction chamber 3 needs to be provided for each dephlegmator unit. It should be noted that a pipe bundle configured as dephlegmator 1 has a width of preferably about 2.2 m.

Figure 2:
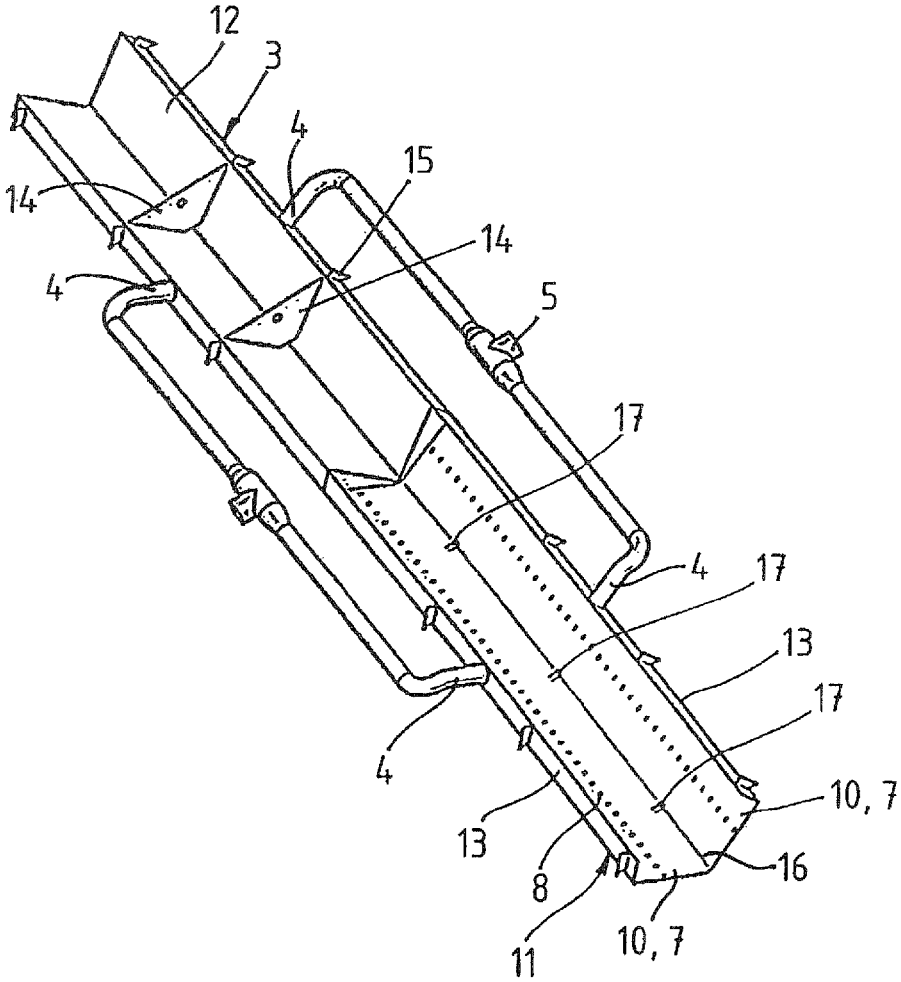
FIG. 2 a perspective view on the suction chamber of FIG. 1 is an open and a closed state.

The structure of the suction chambers 3 is illustrated more clearly in the perspective diagram of FIG. 2. The suction chamber 3 on the left-hand side of this Figure is closed off with a cover plate 12 implemented as a folded V-shaped metal sheet. This cover plate 12 is welded to a bottom part 11 of the suction chamber 3. The bottom part 11 is formed by the bottom plates 10 and the sidewalls 13 which form an angle of 90° with the bottom plates 10. The edges of the cover plate 12, which is reinforced by additional triangular vacuum supports 14, are welded to the sidewalls 13. In addition, spacers 15 are arranged on the sidewalls 13 at regular intervals, as will be described below in more detail. The spacers 15 are arranged in the same spatial plane as the vacuum supports 14.

Figure 3:
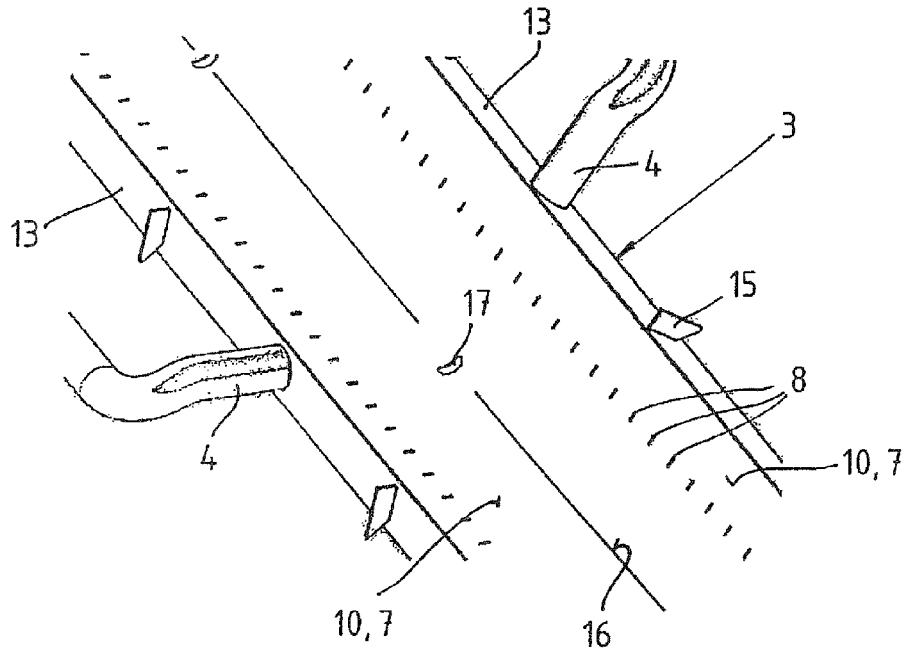
FIG. 3 an enlarged representation of FIG. 2.

As can also be seen, the cross-section of the suction chamber 3 becomes narrower towards the center, i.e., it is smallest where the fold between the bottom plates 10 occurs. The lowest point of the suction chamber 3 is located in this region of the fold. This region is referred to as the bottom 16 and includes uniformly spaced condensate outlet openings 17. The condensate outlet openings 17 are elongated holes, so that they extend on both sides of the fold, as seen in the enlarged diagram of FIG. 3.

The suction chamber 3 is divided into a first sub-chamber 19 associated with the corresponding dephlegmator 1 and a second sub-chamber 19*a* having a gas-tight separation from the first sub-chamber 19. The sub-chambers 19, 19*a* are constructed mirror-symmetrically, while the suction chamber 3 is constructed symmetrically, and are coupled to an unillustrated suction pipe. As can be seen, a steam-gas mixture indicated by the arrows P rises from the heat exchanger pipes 2, wherein condensate droplets T are formed inside the heat exchanger pipe 2, which precipitate on the wall of the heat exchanger pipe 2 and are moved as condensate K to an unillustrated condensate line in the bottom region of the dephlegmators 1. As can be seen, the cross-section of the baffle openings 8 is significantly smaller than the cross-sectional area of the exit opening 9 of the heat exchanger pipes 2.

Figure 4:
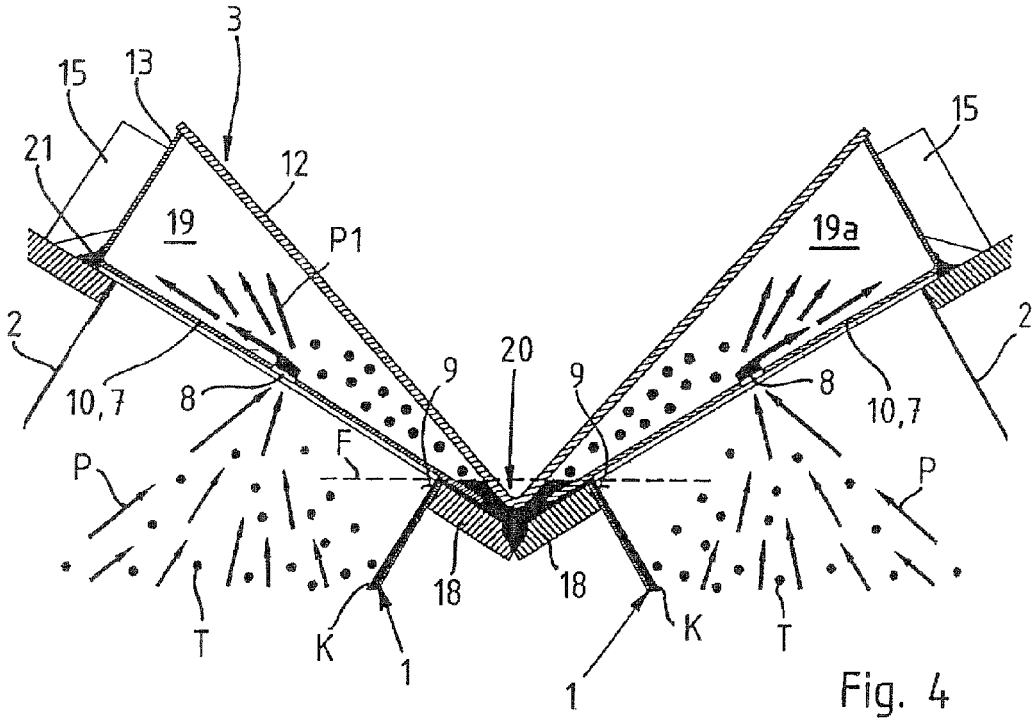
FIG. 4 the suction chamber of FIGS. 1 to 3 in cross-section.

The steam-gas mixture passing through the baffle opening 8 is condensed at least proportionally, whereby gas is suctioned off upwardly, in the direction of the arrows P1, whereas condensate droplets T move downward due to gravity and accumulate at the bottom 16 of the suction chamber 3. The condensate K passes through the condensate outlet opening 17, which is depicted in FIG. 4 only as a discontinuity in the bottom plate 10, and accumulates above a pipe bottom 18 which holds the heat exchanger pipes 2. The pipe bottoms 18 of the two dephlegmators are welded to one another gas-tight. The condensate K moves through the condensate outlet openings 17 underneath the respective bottom plates 10 which are arranged with a small gap from the pipe bottoms 18. This gap is absolutely necessary and is defined by spacers 15 which are also supported on the pipe bottoms 18. The condensate can rise through the generated gap to the fill level indicated by the dashed line F. The fill level F corresponds to the height of the lowest regions of the outlet openings 9. In other words, the condensate K can rise until it is able flow again through the gap between the bottom plates 10 and the pipe bottoms 18 via the outlet openings 9 into the heat exchanger pipes 2, where it mixes with the remaining condensate flow.

One particular feature is that the cover plate 12 extends below the fill line F and is immersed in the backed-up condensate. As a result, a gas barrier 20 is formed by the bottom plate 10 and/or the baffle 7, the pipe bottom 18 arranged underneath the bottom plate 10, and the condensate K, which prevents the steam-gas mixture from moving from the left sub-chamber 18 into the right sub-chamber 19. Discharge of the condensate K also ensures that the baffle openings 8 are not located below the fill line F, so that the steam-gas mixture enters the suction chamber 3 via a path that is different from that path provided for discharging the condensate K. This prevents so-called "swallowing" of the discharging condensate by the steam-gas mixture suctioned off in the counter-flow.

The prefabricated suction chamber 3 is welded to the pipe bottoms 18 with an ideally placed fillet weld to form a complete assembly. The suction chamber 3 is here held by the spacers 15 at a defined minimum distance of preferably 1 mm with respect to the unillustrated weld seam bumps formed in the pipe bottoms 18 by the pipe welds. In this way, a single chamber for each heat exchanger pipe 2 is automatically produced, which can be continuously suctioned off through the outlet opening 8.

The invention claimed is:

1. An air-supplied dry cooler for condensing steam to form a condensate, comprising:

at least one direct-flow condenser;

at least one counter-flow condenser (dephlegmator) having heat exchanger pipes;

a plurality of heat exchanger pipes having outlet openings;

an upper suction chamber having a bottom and being connected to the heat exchanger pipes;

a baffle with baffle openings for reducing an outlet cross-section of at least one of the heat exchanger pipes;

a gas barrier, wherein condensate entering the suction chamber through a baffle opening accumulates in the bottom of the suction chamber and is returned to a heat exchanger pipe via the gas barrier; and a pipe bottom disposed underneath the baffle, wherein the gas barrier is formed by the baffle, the pipe bottom and the condensate, wherein accumulating condensate is introduced into the outlet openings of the heat exchanger pipes affixed to the pipe bottom.

2. An air-supplied dry cooler for condensing steam to form a condensate, comprising:

at least one direct-flow condenser;

at least one counter-flow condenser (dephlegmator) having heat exchanger pipes;

a plurality of heat exchanger pipes having outlet openings;

an upper suction chamber having a bottom and being connected to the heat exchanger pipes;

a baffle with baffle openings for reducing an outlet cross-section of at least one of the heat exchanger pipes, said baffle having, at least in regions, a gap between the baffle and the outlet opening of the heat exchanger pipes; and a gas barrier, wherein condensate entering the suction chamber through a baffle opening accumulates in the bottom of the suction chamber and is returned to a heat exchanger pipe via the gas barrier.

3. The dry cooler of claim 2, wherein the spacing is at most 1mm.

4. The dry cooler of claim 2, wherein the outlet openings are surrounded by weld seam bumps, wherein the spacing is measured with reference to the weld seam bumps.

5. An air-supplied dry cooler for condensing steam to form a condensate, comprising:

at least one direct-flow condenser;

at least one counter-flow condenser (dephlegmator) having heat exchanger pipes;

a plurality of heat exchanger pipes having outlet openings;

an upper suction chamber having a bottom plate and being connected to the heat exchanger pipes;

a baffle with baffle openings for reducing an outlet cross-section of at least one of the heat exchanger pipes, said baffle comprising condensate outlet openings and being part of the bottom plate of the suction chamber; and a gas barrier, wherein condensate entering the suction chamber through a baffle opening accumulates in the bottom of the suction chamber and is returned to a heat exchanger pipe via the gas barrier.

6. The dry cooler of claim 1, wherein a pair of dephlegmators that face one another in a roof-shaped arrangement are connected in common to a corresponding suction chamber.

7. An air-supplied dry cooler for condensing steam to form a condensate, comprising:

at least one direct-flow condenser;

at least one counter-flow condenser (dephlegmator) having heat exchanger pipes;

a plurality of heat exchanger pipes having outlet openings;

an upper suction chamber having a bottom and being connected to the heat exchanger pipes;

a baffle with baffle openings for reducing an outlet cross-section of at least one of the heat exchanger pipes; and a gas barrier, wherein condensate entering the suction chamber through a baffle opening accumulates in the bottom of the suction chamber and is returned to a heat exchanger pipe via the gas barrier, said gas barrier being formed by a separation wall separating the suction chamber into a first sub-chamber associated with a first dephlegmator and a second sub-chamber associated with second dephlegmator, with the condensate accumulating in the bottom of the suction chamber located between the first and second dephlegmator up to a blocking height, and with the separation wall immerging in the condensate.

8. The dry cooler of claim 7, wherein the separation wail is formed by a cover plate which closes the suction chamber.

9. The dry cooler of claim 5, further comprising a suction pipe connected to the suction chamber, wherein the bottom plate is constructed as a single piece from a sheet bar having perforations in region of the outlet openings of the heat exchanger pipes, the condensate outlet openings and of the suction pipe, wherein the sheet bar is folded commensurate with a slope of the pipe bottoms.

10. The dry cooler of claim 5, wherein the suction chamber has a sidewall formed in one piece with the bottom plate.

11. The dry cooler of claim 10, further comprising a spacer arranged on the sidewall and affixed to the bottom plate.

12. The dry cooler of claim 1, further comprising a pipe bottom disposed underneath the baffle, wherein the suction chamber has an edge which is connected gas-tight to the pipe bottom through a welding process.

13. The dry cooler of claim 1, further comprising a single suction pipe connected to a suction chamber that extends over a total width of a dephlegmator.

* * * * *